US006319884B2

(12) United States Patent
Leduc et al.

(10) Patent No.: US 6,319,884 B2
(45) **Date of Patent: *Nov. 20, 2001**

(54) METHOD FOR REMOVAL OF CURED POLYIMIDE AND OTHER POLYMERS

(75) Inventors: Marilyn R. Leduc, Williston; Harold G. Linde, Richmond; Gary P. Viens, Colchester, all of VT (US)

(73) Assignee: International Business Machines Corporation, Armonk, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,094

(22) Filed: Jun. 16, 1998

(51) Int. Cl.[7] ..... C11D 3/30

(52) U.S. Cl. ..... 510/175; 510/176; 510/178; 510/197; 510/200; 510/201; 510/202; 510/212; 510/254; 510/407; 510/499; 510/500; 134/1.2; 134/1.3

(58) Field of Search ..... 510/175, 176, 510/178, 197, 200, 201, 202, 212, 254, 407, 499, 500; 134/1.2, 1.3

(56) References Cited

U.S. PATENT DOCUMENTS

| | | | | |
|---|---|---|---|---|
| 3,932,653 | * | 1/1976 | Stoughton | 424/285 |
| 4,276,186 | | 6/1981 | Bakos et al. . | |
| 4,617,251 | * | 10/1986 | Sizensky | 430/256 |
| 4,732,695 | * | 3/1988 | Francisco | 252/162 |
| 5,091,103 | | 2/1992 | Dean et al. . | |
| 5,098,594 | * | 3/1992 | Doscher | 252/162 |
| 5,204,026 | * | 4/1993 | Doscher-Good | 252/542 |
| 5,279,771 | * | 1/1994 | Lee | 252/548 |
| 5,334,322 | * | 8/1994 | Lee | 252/548 |
| 5,334,332 | | 8/1994 | Lee . | |
| 5,381,807 | * | 1/1995 | Lee | 134/2 |
| 5,419,779 | | 5/1995 | Ward . | |
| 5,431,777 | | 7/1995 | Austin et al. . | |
| 5,456,760 | * | 10/1995 | Goehausen | 134/42 |
| 5,480,585 | | 1/1996 | Shiotsu et al. . | |
| 5,482,566 | * | 1/1996 | Lee | 134/42 |
| 5,554,312 | * | 9/1996 | Ward | 510/175 |
| 5,597,420 | | 1/1997 | Ward . | |
| 5,672,577 | * | 9/1997 | Lee | 510/175 |
| 5,690,747 | * | 11/1997 | Doscher | 134/1 |
| 5,798,323 | * | 8/1998 | Honda et al. | 510/176 |
| 5,911,836 | * | 6/1999 | Hada et al. | 134/2 |

OTHER PUBLICATIONS

Aldrich Chemical Company Inc., Aldrich Catalog Handbook of Fine Chemicals pp. 487 and 640, 1994–1995.*

* cited by examiner

*Primary Examiner*—Yogendra N. Gupta
*Assistant Examiner*—Charles Boyer
(74) *Attorney, Agent, or Firm*—Howard J. Walter, Jr.

(57) ABSTRACT

Non-aqueous cleaning compositions capable of removing cured polyimides and other polymers from a metal circuitry containing substrate such as a semiconductor device for rework and other purposes without any significant adverse affect on the circuitry are provided consisting essentially of alkanolamines, preferably monoethanolamine or monoethanolamine-diethanolamine mixtures and optionally with a solvent such as NMP in an amount less than about 50% by weight. A method is also provided for removing polyimide coatings and other polymers from semiconductor devices using the cleaning compositions of the invention.

3 Claims, No Drawings

METHOD FOR REMOVAL OF CURED POLYIMIDE AND OTHER POLYMERS

BACKGROUND OF THE INVENTION

1. Field of the Invention

This invention relates generally to stripping compositions to remove polymer coatings from electronic components and, more particularly, to a stripping composition that removes polyimide coatings from semiconductor integrated circuit devices for rework of the device without damaging the underlying metal circuitry of the device. In one particular application, a cured polyimide used as a top seal of an integrated circuit chip module is removed for rework using a method employing the stripping composition of the invention.

2. Description of Related Art

The manufacture of semiconductor integrated circuits typically involves highly complex, time-consuming and costly processes which, with continually narrower line width requirements, must be achieved with an ever increasing degree of precision. During the manufacture of the semiconductor and semiconductor microcircuits, it is necessary to coat the substrates from which the semiconductors and microcircuits are made with a polymeric organic film, generally referred to as a photoresist, e.g., a substance which forms a patterned image upon exposure to light and developing. These type photoresists are used to protect selected areas of the surface of the substrate while a process such as etching is used to selectively modify materials at unprotected areas of the substrate.

In the manufacture of integrated circuits, the process steps include coating onto the surfaces of semiconductor substrates materials such as metals to define the circuitry, dielectrics as insulators and organic polymeric materials to protect the circuit patterns in the electronic component. The substrate is typically an $SiO_2$ dielectric covered silicon wafer and contains metallic microcircuitry such as aluminum or aluminum alloys in and/or on the dielectric surface.

Basically, the fabrication of integrated circuits utilizes a photoresist composition which generally comprises a polymeric resin, a radiation sensitive compound and a suitable solvent to enable forming a film of the photoresist over a particular substrate for photolithographically delineating patterns on such substrates. In a typical processing scheme, the photoresist compositions are spun on or applied to the substrate using methods known in the art. Then the photoresist compositions are typically subjected to a pre-exposure bake to drive off a portion of the solvent to impart dimensional stability to the film. The coated substrate is selectively exposed with radiation such as UV, e-beam or x-ray spectra through a patterning mask using an appropriate exposure tool for such exposure. After exposure, the coated substrate undergoes a development process where, due to selective dissolution of certain areas, a pattern is formed or developed. In certain areas of the photoresist film, the photoresist material is completely removed whereas in the other areas the remaining photoresist forms a pattern having a desired or intended configuration. Such patterns are used to mask or protect the substrate for subsequent wet or dry etching processes, the deposit of conductor or insulative patterns, or for incorporation of the pattern photoresist into the device or package as, for example, an insulating or dielectric layer.

In one fabrication process for an integrated circuit, a top coating can be applied to the integrated circuit. Typically, a polymer layer is applied to the top surface of the integrated circuit and developed to expose pads on the surface of the integrated circuit device. The polymer is then cured and an interconnect is made through the surface of the integrated circuit device.

Polyimides are increasingly being used in integrated circuit manufacture. The use of a polyimide as a fabrication aid includes application of the polyimide as a photoresist, planarization layer and insulator. In these applications, the polymers are applied to a wafer substrate and subsequently cured in the desired pattern by a suitable method. When the polyimide is used as a seal or a top coat, the polyimide layer is not removed except for the areas over the pads and remains on the surface of the semiconductor device.

Semiconductor devices are very expensive and if there is a defect in the device, it is highly desirable to be able to repair the device. To repair (typically termed "rework") the device, it is necessary to remove coatings such as polyimides, epoxies and the like and it is essential that the underlying metallization of the device not be adversely affected by the stripping composition.

SUMMARY OF THE INVENTION

Bearing in mind the problems and deficiencies of the prior art, it is therefore an object of the present invention to provide a stripping composition which is effective to remove polyimides, epoxies, hardened photoresists, and other polymer coatings from semiconductor substrates without adversely affecting the metallic circuitry of the device.

It is another object of the present invention to provide a method for removing polyimides, epoxies, hardened photoresists, and other polymers from semiconductor devices using a stripping composition and which method does not adversely affect the metallic circuitry of the device.

A further object of the invention is to provide semiconductor devices which have been reworked by removing polyimides, epoxies, hardened photoresists, or other polymer layers from the semiconductor device.

Other objects and advantages of the present invention will be readily apparent from the following description.

The above and other objects and advantages, which will be apparent to one of skill in the art, are achieved in the present invention which is directed, in a first aspect, to a non-aqueous cleaning composition capable of removing cured polyimides, epoxies, hardened photoresists, and other polymers, e.g., in the form of photoresists, top seals, top coatings, etc., from a metal containing substrate such as a semiconductor device without any significant adverse effect, e.g., corrosion, on the metal the composition consisting essentially of less than 50% by weight of a solvent such as N-methyl-2-pyrrolidone (NMP) and at least one alkanolamine defined by the following formula:

$$H_{3-n}N((CH_2)_m(CHOH)(R))_n$$

wherein m is 1 or 2;

R is H or $C_1$–$C_3$ alkyl; and n is 1, 2 or 3.

The preferred alkanolamines are the monoethanolamines specifically monoethanolamine, and diethanolamine wherein m is 1, R is H and n is 1 or 2. In a highly preferred embodiment, the solvent such as NMP is less than 10%, by weight. In a further highly preferred embodiment, the non-aqueous cleaning composition consists essentially of monoethanolamine.

For some stripping applications it is preferred to use a mixture of alkanolamines, e.g., monoethanolamine and diethanolamine, and the non-aqueous cleaning composition consists essentially of, by weight, about 50 to 100% monoethanolamine and 0 to 50% diethanolamine, preferably 90 to 100% monoethanolamine and 0 to 10% diethanolamine.

In another aspect of the invention, a method is provided for removing polyimide, cured polyimide, epoxy, photoresist, hardened photoresist, or other polymers from substrates such as semiconductor devices comprising the steps of:

providing a substrate such as a semiconductor device having a polyimide or other polymer as part of the device;

contacting the substrate for an effective time with a non-aqueous cleaning composition at an elevated temperature, the non-aqueous cleaning composition consisting essentially of less than 50% by weight of a solvent such as NMP and at least one alkanolamine having the formula:

$$H_{3-n}N((CH_2)_m(CHOH)(R))_n$$

wherein m is 1 or 2;

R is H or $C_1$–$C_3$ alkyl; and n is 1, 2 or 3.

The temperature of the cleaning solution may vary widely with higher temperatures generally providing faster removal rates. A cleaning composition temperature of above room temperature, e.g., 35° C. to 170° C., preferably 75 to 135° C. is preferred for a removal rate of less than about 1–3 hours.

In another aspect of the invention, it is preferred to use a cleaning composition at a temperature higher than its flash point to provide enhanced stripping results. For example, a composition consisting essentially of monoethanolamine having a flash point of about 93° C. may be used at a temperature of about 130–135° C. to remove a polyimide having a thickness of 6–8 microns in less than 1 hour. Depending on the process, an inert atmosphere can be used during the stripping operation.

DESCRIPTION OF THE PREFERRED EMBODIMENT (S)

The cleaning compositions of the present invention are especially suitable for removing polyimide, cured polyimide, epoxy, photoresist, hardened photoresist, or other polymers from semiconductor devices without adversely affecting the metal circuitry of the device.

The alkanolamines of the present invention are defined by the following formula:

$$H_{3-n}N((CH_2)_m(CHOH)(R))_n$$

wherein m is 1 or 2;

R is H or $C_1$–$C_3$ alkyl; and n is 1, 2 or 3.

The alkanol group of the amine is preferably an unsubstituted group and contains preferably two carbon atoms. Examples of suitable alkanol amines include monoethanolamine, diethanolamine, triethanolamine, aminopropanol, diaminopropanol and the like. The preferred alkanol amines are monoethanolamine and diethanolamine with monoethanolamine being highly preferred.

A preferred cleaning composition consists essentially of monoethanolamine. Using this composition, it has been found that polyimides and other polymers such as photoresists and epoxies may be readily removed from the substrate in a relatively short time. For this composition, which may contain up to about 50%, by weight, preferably less than 25%, and most preferably less than 10%, of a solvent such as NMP, the operating temperature will be about 35 to 170° C., preferably 75 to 150° C. It is preferred to employ the composition at a temperature above the 93° C. flash point of the monoethanolamine, e.g., 130–135° C., and it is highly preferred that an inert atmosphere such as nitrogen be used during the contacting and polymer removing process.

In another aspect of the invention, mixtures of alkanolamines may be suitably employed. The two preferred alkanolamines, monoethanolamine and diethanolamine, are preferred for use as a cleaning composition and, in general, the composition consists essentially of, by weight, about 50 to 90% monoethanolamine, preferably about 75 to 90% and about 10 to 50%, preferably 10 to 25% diethanolamine. The operating temperature for a monoethanolamine and diethanolamine cleaning composition mixture is above room temperature, e.g., 35° C., to 200° C., preferably 75° C. to 150° C. and most preferably 100° C.–135° C.

The cleaning compositions of the invention may also contain less than about 50%, by weight, NMP or other solvent such as dimethylformamide, hexamethylphosphoramide and dimethylacetamide. It is important that the solvent be miscible with the alkanolamine and form a solution. In a preferred embodiment, the NMP is less than about 10% by weight and most preferably less than 1%, e.g., 0% of the cleaning composition. The NMP has been found to be useful to provide certain stripping properties due to its properties as a good aprotic solvent, but is an optional component of the composition.

Other solvents and other components may be included in the composition which do not adversely affect the stripping composition to an undesirable extent. For example, minor amounts of surface active agents, glycols, other solvents and the like may be employed.

The substrates which are treated according to the present invention include those substrates commonly used in the preparation of integrated circuit modules or carriers such as ceramic substrates. The substrate materials are well known in the art and are basically silicon wafers, ceramic materials such as aluminum oxides, silicon oxides and silicates, silicon nitride, germanium and aluminum.

While the cleaning compositions of the present invention may be used at any step in the fabrication process, it is an important feature of the invention that the cleaning compositions are particularly effective to remove fully cured polyimides and other polymers for rework of the component. Basically, rework of the component may be defined as removal of a polymer layer from the component without adversely affecting the circuitry of the component and then repairing the component as needed.

The substrate contains a polymer particularly a polyimide or polyimide residue which is obtained from polyamic acid, polyamic ester, polyamic acid salt, polyimide, photosensitive polyimide or photosensitive polyimide precursors.

The components are typically treated using the stripping compositions of the invention by dipping the substrates into a vessel which contains the cleaning composition. The temperature of the composition is as noted above and the contact time in the vessel is generally less than about 2 hours, preferably from about 30 minutes to about 60 minutes. The temperature of the composition and contact time are inversely related. That is, the higher the temperature, the shorter the contact time to assure removal of the coating. The contact can be carried out with some agitation of the composition such as by stirring or shaking to facilitate contact of the composition with the substrate. Also, the composition can be recirculated to a heat exchanger in order to maintain and control the temperature of the composition.

The substrate, after contact with the composition and removal of the polymer layer therefrom, is typically rinsed with a solvent such as NMP or with water to wash off any remaining cleaning composition.

The cleaning compositions are capable of removing polyimide, cured polyimide, epoxy, photoresist, hardened photoresist, or other polymers from a semiconductor device. The stripping compositions of the present invention are effective in removing a number of polymer coatings such as polyimide coatings even when the polyimide coatings have been subjected to a high temperature cure including a cure performed at a temperature as high as about 400° C. These type polyimide coatings are considered to be fully cured and are more difficult to remove from the substrate than partially cured polyimide coatings. The photoresist that may be stripped with the stripping compositions of the present invention include the photosensitive polyimides mentioned above and also novolak and phenolic resins. When a hard-bake novolak is used, the novolak photoresist is typically exposed to a source of radiation to create a latent image. The latent image is subsequently developed using standard aqueous base developer. After development, the pattern novolak resist is baked at a temperature of about 210° C. to provide the hard-bake pattern novolak resist.

The conductive metal typically used to form the circuitry in the semiconductor device is a metal or metal alloy such as aluminum, copper, aluminum-copper, aluminum-silicon and aluminum-copper-silicon.

Examples illustrating the removal of a polymer such as a photosensitive polyimide from a substrate under varying conditions using the stripping compositions of the present invention are described hereinbelow. The following examples are provided to further illustrate the present invention and are not intended to limit the scope of the present invention.

Example 1

The following stripping compositions (wt %) were prepared as indicated. A fully integrated silicon wafer with a cured photosensitive polyimide coating was immersed in the composition for the indicated temperature and times. The polymer is OLIN PROBIMIDE 7510 baked to 350° C., low cure (No. A, B, C, D and 1); or baked to 375–400° C., fully cured (No. 2).

TABLE A

| NO. | STRIPPING COMPOSITION | TEMP ° C. | TIME | RESULT |
|---|---|---|---|---|
| A | NMP 30/ | 65 | 6 hr | good/edge buildup |
| | monoethanol- | 100 | 15 min | good/slight pitting |
| | amine 70 | 130 | 1 min | good |
| B | diethanolamine 90/ | 115 | 15 min | good |
| | monoethanol- | 120 | 1 hr | good |
| | amine 10 | 135 | 1.83 hr | residual pad edge |
| | | 135 | 1.66 hr | residual pad edge |
| C | diethanolamine 100 | 105 | 1 hr | good |
| D | monoethanol- | 90 | 5 hr | residual pad edge |
| | amine 100 | 90 | 3 hr | good |
| | | 100 | 3 hr | good |
| | | 100 | 2 hr | good |
| 1 | NMP 90/ | 80 | 6 hr | bad, residuals |
| | monoethanol- | 100 | 1.5 hr | slight residual, edge |
| | amine 10 | 150 | 1 min | good, no metal pits |
| | (Flash Point is | 100 | 1 hr | residual pad edges |
| | 90–95° C.) | | | |

TABLE A-continued

| NO. | STRIPPING COMPOSITION | TEMP ° C. | TIME | RESULT |
|---|---|---|---|---|
| 2 | NMP 90/ | 150 | 2 min | unremoved |
| | monoethanol- | 150 | 10 min | residuals |
| | amine 10 | | | |

The results show that stripping composition 1 or 2 (not of the invention) do not effectively strip either the low cure or fully cured polyimide even when soaked at an extremely high temperature. Stripping compositions A, B, C, and D (of the invention) effectively strip the polyimide over a wide range of operating temperatures.

Polyimide receiving a lower temperature final bake of below about 350° C. were found strippable in the 30/70 NMP/monoethanolamine and monoethanolamine/diethanolamine mixtures of the invention. Polyimide receiving cures of above about 350° C. were not fully attacked by these formulations of the invention. However, these formulations do not attack aluminum, and it has been found that the mixture must be essentially water-free to avoid such corrosion attack on aluminum.

EXAMPLE 2

Polymer materials as indicated below were coated as films on silicon wafers. The coated wafer was then immersed in 100% monoethanolamine at the indicated temperatures and times. The results are shown in Table B.

TABLE B

| | Polymer | | | |
|---|---|---|---|---|
| | A | B | C | D |
| Temp 100–120° C; ramped; for 1 hour | | | | |
| Al Pitting | Slight | No | NA | NA |
| Residual Polymer | Yes | No | No | Slight |
| Temp 110–115° C. for 1 hour | | | | |
| Al pitting | Little | No | NA | NA |
| Residual Polymer | No | No | No | Slight |
| Temp 130° C. for 20 min. | | | | |
| Al pitting | Slight | No | NA | NA |
| Residual Polymer | No | No | No | No |
| Temp 145° C. for 15 min. | | | | |
| Al pitting | Slight | No | NA | NA |
| Residual polymer | No | No | No | No |

Polymer A is a photosensitive polyimide OLIN PROBIMIDE 7510 baked at 375–400° C. fully cured with Al metallurgy.

Polymer B is PMDA-ODA polyimide DuPont product 5878 baked at 350° C. fully cured with A1 metallury.

Polymer C is Hoecht-Celamese AZ 7525 photoresist baked at 100° C.—no metallurgy.

Polymer D is polymer C baked and implanted with $5\times10^{15}$ phosphorous at 160OKEV—no metallurgy.

NA—Not Applicable

Slight means enhances grain boundaries on the surface—commercially acceptable.

Little means very minor pitting—commercially acceptable.

The results show pure monoethanolamine to be very effective in removing polymer materials that have been cured above 350° C. from silicon wafers without damaging exposed aluminum. Thus, active devices can be reworked without risk of damaging aluminum, even if their polyimide coating has been fully cured.

EXAMPLE 3

A semiconductor wafer having copper lines was immersed in 100% ethanolamine and heated at 130C. for 3 hours. No pitting was observed in the copper lines and small copper features were retained without degradation.

EXAMPLE 4

A semiconductor chip coated with epoxy was immersed in 100% ethanolamine and heated at 130C for 2 hours. The epoxy was completely removed and no pitting was observed in the copper lines on the chip.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for removing polyimide, cured polyimide, epoxy photoresist, hardened photoresist, or other polymers from a substrate comprising the steps of:

providing a substrate comprising aluminum or copper, said substrate further comprising a polyimide, cured polyimide, epoxy, photoresist hardened photoresist, or other polymer coating;

contacting said substrate for an effective time with a composition of 100 percent of one of monoethanolamine or diethanolamine at an elevated temperature between room temperature and about 170° C.; and removing said polyimide, cured polyimide, epoxy, photoresist, hardened photoresist or other polymer from said substrate without any significant adverse effect on said aluminum or copper.

2. The method of claim 1 wherein the temperature is about 75–150° C.

3. The method of claim 1 wherein the temperature is about 100° C.

* * * * *